US005245954A

United States Patent [19]

Donohue

[11] Patent Number: 5,245,954

[45] Date of Patent: Sep. 21, 1993

[54] AXIAL FAN FLYWHEEL

[75] Inventor: James A. Donohue, Pewaukee, Wis.

[73] Assignee: Outboard Marine Corporation, Waukegan, Ill.

[21] Appl. No.: 908,159

[22] Filed: Jul. 2, 1992

[51] Int. Cl.[5] ..... F01P 7/04

[52] U.S. Cl. ..... 123/41.65; 123/149 D; 74/572

[58] Field of Search ..... 123/41.11, 41.31, 41.48, 123/41.63, 41.65, 149 D; 74/572

[56] References Cited

U.S. PATENT DOCUMENTS

| | | | |
|---|---|---|---|
| 3,782,851 | 1/1974 | Harckbarth et al. | 415/213 |
| 4,134,370 | 1/1979 | Iwahashi et al. | 123/41.31 |
| 4,550,697 | 11/1985 | Campen | 123/149 D |
| 4,603,664 | 8/1986 | Jackson | 123/149 D |
| 4,606,305 | 8/1986 | Campen | 123/149 D |
| 4,982,705 | 1/1991 | Hudson | 123/41.65 |

FOREIGN PATENT DOCUMENTS

| | | | |
|---|---|---|---|
| 109962 | 4/1900 | Fed. Rep. of Germany | 123/41.65 |

*Primary Examiner*—Noah P. Kamen

*Attorney, Agent, or Firm*—Michael, Best & Friedrich

[57] ABSTRACT

Disclosed herein is a flywheel comprising a flywheel structure including a hub portion having an axis, an inner end, and an outer end spaced axially from the inner end, a central flange portion extending radially outwardly from the outer end of the hub portion in generally perpendicular relation to the axis of the hub portion, and having a circular outer periphery, an outer portion including a generally cylindrical wall part extending from the outer periphery of the central flange portion in generally spaced and parallel relation to the hub portion and including an end axially adjacent the inner end of the hub portion, and a plurality of exit openings located in the central flange portion and permitting air flow relative to the central flange portion, and a fan structure including a like plurality of inclined vanes located between the exit openings and extending, in inclined relation in the rotary direction counter to the intended direction of flywheel rotation, and operable to cause air flow through the exit openings.

4 Claims, 1 Drawing Sheet

AXIAL FAN FLYWHEEL

BACKGROUND OF THE INVENTION

The invention relates generally to flywheels and more particularly to flywheels which are also constructed to act as fans.

Attention is directed to U.S. Pat. 5,078,101 which issued Jan. 7, 1992, and which discloses a flywheel which is of inverted cup shape defining a recess in which heat generating ignition components are located. The construction disclosed in U S. Pat. 5,078,101 includes a circular array of openings in a series of vanes or fins which project upwardly from the top or upper surface of the flywheel and which function like a centrifugal fan and act to cause air flow outwardly through the openings and from the interior of the recessed interior of the cup shaped portion of the flywheel. The fins or vanes also act to centrifugally displace air above the flywheel and thus less then the maximum air flow from the interior recess of the flywheel is achieved, with consequent diminishment of possible heat removal.

Attention is also directed to the following United States Patents:

| | | |
|---|---|---|
| 3,782,851 | Hackbarth, et al. | January 01, 1974 |
| 4,134,370 | Iwahashi, et al. | January 16, 1979 |
| 4,550,697 | Campen | November 05, 1985 |
| 4,603,664 | Jackson | August 05, 1986 |
| 4,606,305 | Campen | August 19, 1986 |

SUMMARY OF THE INVENTION

The invention provides a flywheel comprising a hub portion having an axis, an inner end, and an outer end spaced axially from the inner end, an inner flange portion extending radially outwardly from the outer end of the hub portion in generally perpendicular relation to the axis of the hub portion and having a radially outer periphery, a generally cylindrical wall portion extending from the outer periphery of the inner flange portion in generally spaced relation to the hub portion and in generally parallel relation to the axis of the hub portion and in the direction toward the inner end of the hub portion from the outer end of the hub portion and including an end axially spaced from the outer end of the hub portion, whereby to define a recess defined between the hub portion, the cylindrical wall portion, and the inner flange portion, an outer flange portion extending radially outwardly from the end of the cylindrical wall portion in generally perpendicular relation to the axis of the hub portion, and means including a plurality of vanes structured to displace air in the direction of the axis of the hub portion and relative to the recess.

The invention also provides a flywheel comprising a flywheel structure including a hub portion having an axis, an inner end, and an outer end spaced axially from the inner end, a central flange portion extending radially outwardly from the outer end of the hub portion in generally perpendicular relation to the axis of the hub portion and having a radially outer periphery, an outer portion including a generally cylindrical wall part extending from the outer periphery of the central flange portion in generally spaced and parallel relation to the hub portion and in the direction toward the inner end of the hub portion from the outer end of the hub portion and including an end axially adjacent the inner end of the hub portion, and an outer flange part extending radially outwardly from the end of the cylindrical wall part in generally perpendicular relation to the axis of the hub portion, and a plurality of exit openings located in one of the central flange portion and the cylindrical wall part and permitting outward air flow from below the central flange portion, a fan structure including a radially outer ring portion, a radially inner ring portion, one of the inner and outer ring portions having an under surface, and an intermediate circular portion located between the inner and outer ring portions and including therein a plurality of axially extending openings located in a circular spaced array, and a like plurality of inclined vanes located in the intermediate circular portion between the openings in the intermediate circular portion and extending, in inclined relation, upwardly from the under surface and in the rotary direction counter to the intended direction of flywheel rotation, and means for fastening the fan structure to the outer portion of the flywheel structure.

Other features of and advantages of the invention will become apparent to those skilled in the art upon review of the following detailed description, claims, and drawings.

THE DRAWINGS

Figure 1:
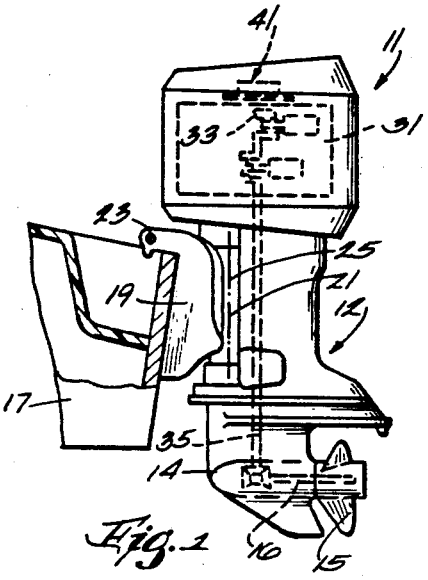
FIG. 1 is a perspective view of a marine propulsion device which is in the form of an outboard motor and which incorporates a flywheel embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a marine propulsion device 11 which is in the form of an outboard motor and which comprises a propulsion unit 12 including a gear case 14 supporting a propeller shaft 16 for rotary movement. Fixed on the propeller shaft 16 for common rotation therewith is a propulsion element in the form of a propeller 15.

In one embodiment, the propulsion unit 12 is pivotally attached to a water craft 17 by means including a stern bracket 19 which is fixed to the watercraft 17 and a swivel bracket 21 which is connected to the stern bracket 19 for rotation about a generally horizontal axis 23 and connected to the propulsion unit 12 for common pivotal movement about the horizontal axis 23 and for pivotal movement of the propulsion unit 12 relative to the swivel bracket 21 about a generally vertical axis 25.

Above the gear case, the propulsion unit 12 comprises a power head including an internal combustion engine 31 including a crankshaft 33 drivingly connected to the propeller shaft 16 by a vertical drive shaft 35. In addition, the propulsion unit 12 includes a flywheel 41 which is mounted on the upper end of the crankshaft 33. The flywheel 41 includes a cup shaped recess or interior 43, and means for axially displacing air into the recess 43 from below and for affording exit of the air from the recess in an axially upward and/or radially outward direction.

More particularly, the flywheel 41 comprises a flywheel structure 51 which is preferably is of one piece integrally cast construction and includes a hub portion 61 which is adapted to be mounted on the crankshaft 33, as generally shown in U.S. Pat. No. 5,078,101, for rotation about an axis 65 and which includes an inner or lower end 67 and an upper or outer end 69. The flywheel structure 51 also includes a central or inner flange portion 71 which extends radially outwardly from the upper or outer end 69 of the hub portion 61 in generally perpendicular relation to the axis 65 of hub rotation. The central flange portion 71 also includes a radially outer circular periphery 73 and has therein means for affording air flow from the recess 43 in a radially outwardly and/or axially upward direction. While other constructions can be employed, in the disclosed construction, such means comprises a plurality of openings 75 located adjacent the outer periphery of the central flange portion 61.

The flywheel structure 51 also comprises an outer portion 79 including a generally cylindrical wall portion or part 81 which extends from the radially outer periphery 73 of the central flange portion 71 in generally spaced and parallel relation to the hub portion 61 and in the direction from the outer end 69 of the hub portion 61 toward the inner end 67 thereof. The cylindrical wall part 81 also includes a lower end 83 located axially adjacent the inner or lower end 67 of the hub portion 61.

The outer portion 79 of the flywheel structure 51 also includes an outer flange portion or part 91 which extends radially outwardly from the lower end 83 of the cylindrical wall part 81 in generally perpendicular relation to the axis 65 of hub rotation and which can include a toothed periphery.

The flywheel 41 also includes a ring or fan structure 101 which is preferably of one piece construction and which includes a radially outer ring portion 103, a radially inner ring portion 105, and an intermediate circular portion 107 between the inner and outer portions 103 and 105. The inner and outer ring portions 103 and 105 include respective generally co-planar undersurfaces 109 and 111.

The intermediate circular portion 107 includes fan means for axially upwardly displacing air into the recess 43 from below. While other constructions can be employed, in the disclosed construction, such means comprises a plurality of openings 121 located in the intermediate circular portion 107 and arranged in an evenly spaced array. The fan means also includes, in the intermediate circular portion, a like plurality of vanes 131 arranged in an evenly spaced array and between the openings 121.

Figure 3:
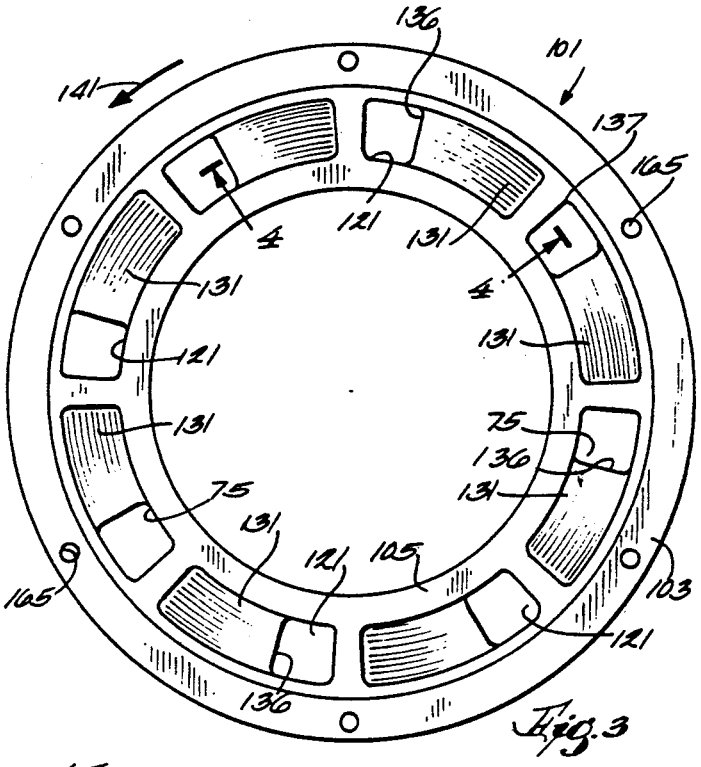
FIG. 3 is a view taken along line 3—3 of FIG. 2 and with part of the flywheel removed for clarity.
Figure 2:
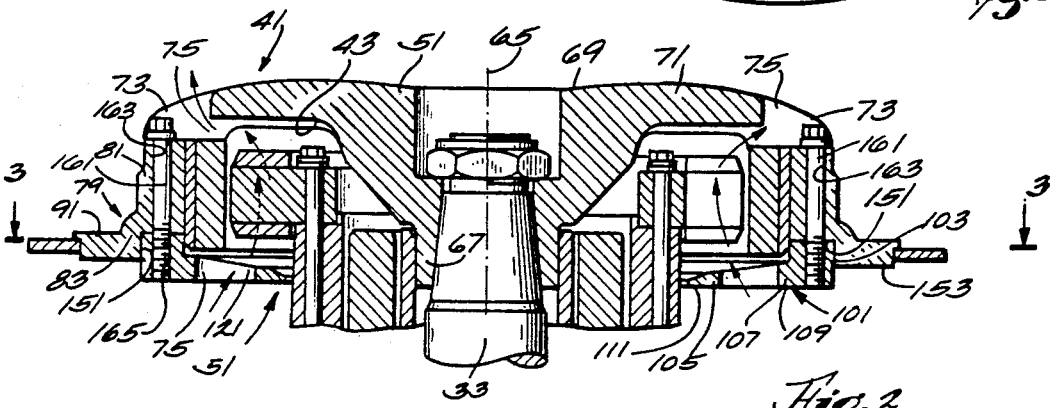
FIG. 2 is an enlarged cross sectional view of the flywheel incorporated in the outboard motor shown in FIG. 1.
Figure 4:
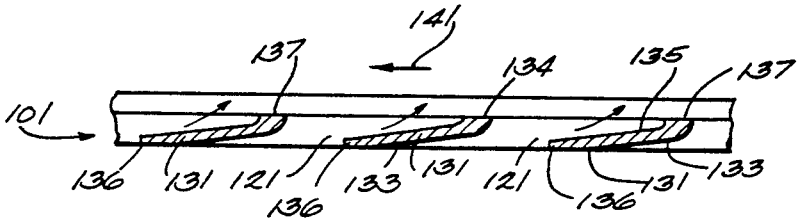
FIG. 4 is an enlarged view taken generally along line 4—4 of FIG. 3.

Still more particularly, the vanes 131 extend upwardly from adjacent the under surface 109 and 111 of the adjacent ring portions 103 and 105 and in the direction counter to the direction of intended flywheel rotation in the counter-clockwise direction as seen from above and as indicated (see FIG. 3 and 4) by the arrow 141.

Still more specifically, the vanes 131 are all generally identically constructed and each includes an undersurface 133 which extends upwardly from the ring portion under surfaces 109 and 111 in the counter-clockwise direction from a location in angularly spaced relation from the trailing end 134 of an adjacent one of the openings 121. The vanes 131 also each include an upper surface 135 which extends upwardly from the ring portion undersurfaces 109 and 111 and in generally spaced and parallel relation to the associated vane under surface 13 to an end 137 located in vertically spaced and angularly adjacent relation to the leading end 136 of the next adjacent one of the openings 121. During rotation, the upper surfaces 135 of the vanes impinge or impact or engage the air and displace the air axially upwardly and into the recesses 43.

The flywheel 41 also includes means for fastening the fan structure 101 to the outer portion 79 of the flywheel structure 51. While various other arrangements can be employed, in the disclosed construction, such means comprises a counter bore 151 which is located in the lower surface 153 of the outer portion 79 of the flywheel structure 51 and which receives the outer ring portion 103 of the fan structure 51, together with a plurality of fasteners 161, such as the illustrated bolts, which extend, in the disclosed construction, in parallel relation to the axis 65 and through openings 163 in the outer portion 79 of the flywheel structure 51 and which are threaded into openings 165 in the outer ring portion 103, whereby to retain the outer ring portion 103 in the counter bore 151 and to retain the outer portion 79 and ring portion 103 in assembled relationship.

In operation, and in response to flywheel rotation, a greater air flow is forced axially into the recess 43 as compared with the arrangement disclosed in U.S. Pat. No. 5,078,101, which greater air flow is more effective in removing the heat generated by the ignition components (not shown) in the recess 43.

Various of the features of the invention are set forth in the appended claims.

I claim:

1. A flywheel comprising a hub portion having an axis, an inner end, and an outer end spaced axially from said inner end, an inner flange portion extending radially outwardly from said outer end of said hub portion in generally perpendicular relation to the axis of said hub portion and having an outer circular periphery, a generally cylindrical wall portion extending from said outer periphery of said inner flange portion in generally spaced relation to said hub portion and in generally parallel relation to the axis of said hub portion and in the direction toward said inner end of said hub portion from said outer end of said hub portion and including an end axially spaced from said outer end of said hub portion, whereby to define a recess defined between said hub portion, said cylindrical wall portion, and said inner flange portion, an outer flange portion extending radially outwardly from said end of said cylindrical wall portion in generally perpendicular relation to the axis of said hub portion, and means including a plurality of openings and vanes located on said inner flange portion and structured to displace air in the direction of the axis of said hub portion and relative to said recess.

2. A flywheel in accordance with claim 1 wherein said vanes are structured to displace air in the direction from said inner end of said hub to said outer end of said hub.

3. A flywheel comprising a flywheel structure including a hub portion having an axis, an inner end, and an outer end spaced axially from said inner end, a central flange portion extending radially outwardly from said outer end of said hub portion in generally perpendicular relation to the axis of said hub portion and having a radially outer periphery, an outer portion including a generally cylindrical wall part extending from said outer periphery of said central flange portion in generally spaced and parallel relation to said hub portion and in the direction toward said inner end of said hub portion from said outer end of said hub portion and including an end axially adjacent said inner end of said hub portion, and an outer flange part extending radially outwardly from said end of said cylindrical wall part in generally perpendicular relation to the axis of said hub portion, and a plurality of exit openings located in one of said central flange portion and said cylindrical wall part and permitting outward air flow from below said central flange portion, a fan structure including a radially outer ring portion, a radially inner ring portion, one of said inner and outer ring portions having an under surface, and an intermediate circular portion located between said inner and outer ring portions and including therein a plurality of axially extending openings located in a circular spaced array, and a like plurality of inclined vanes located in said intermediate circular portion between said openings in said intermediate circular portion and extending, in inclined relation, upwardly from said under surface and in the rotary direction counter to the intended direction of flywheel rotation, and means for fastening said fan structure to said outer portion of said flywheel structure.

4. A flywheel comprising a flywheel structure including a hub portion having an axis, a first end, and an second end spaced axially from said first end, a central flange portion extending radially outwardly from said second end of said hub portion in generally perpendicular relation to said axis of said hub portion and having a circular outer periphery, an outer portion including a generally cylindrical wall part extending from said outer periphery of said central flange portion in generally spaced and parallel relation to said hub portion and including an end axially adjacent said first end of said hub portion, and a plurality of exit openings located in said central flange portion and permitting air flow through said central flange portion, and a fan structure including a like plurality of inclined vanes located between said exit openings and extending in inclined relation to said central flange portion.

* * * * *